United States Patent [19]

Kim

[11] Patent Number: 4,862,704

[45] Date of Patent: Sep. 5, 1989

[54] PLASTIC PAN ASSEMBLY FOR USE IN AIR CONDITIONERS AND REFRIGERATORS

[76] Inventor: Il Y. Kim, 7953 Audubon Ave., B-7, Alexandria, Va. 22306

[21] Appl. No.: 286,863

[22] Filed: Dec. 20, 1988

[51] Int. Cl.[4] ..... F25D 21/02

[52] U.S. Cl. ..... 62/272; 62/285

[58] Field of Search ..... 62/272, 285, 286, 288, 62/289; 248/274, 282, 295.1, 318

[56] References Cited

U.S. PATENT DOCUMENTS

| | | | |
|---|---|---|---|
| 1,950,344 | 3/1934 | Williams | 62/285 X |
| 1,975,066 | 9/1934 | Sanderson | 62/285 X |
| 4,597,269 | 7/1986 | Kim | 62/286 |

*Primary Examiner*—Lloyd L. King

*Attorney, Agent, or Firm*—Birch, Stewart, Kolasch & Birch

[57] ABSTRACT

A plastic primary pan assembly for use in conjunction with an air conditioning system, wherein a channeled supporting bracket is utilized to tightly engage and effectively support a plastic pan which includes a C-shaped circumferential portion having a pair of channels, the channeled supporting bracket having a plurality of elongated apertures being mounted on motor and fan covers which a C-shaped circumferential recess having a pair of rails for smoothly engaging with the plastic pan, whereby the plastic primary pan assembly can be easily associated with and separate from the air conditioning system and easily adjusted to incline the plastic primary pan for drawing condensate water through an outlet disposed in the plastic primary pan.

6 Claims, 2 Drawing Sheets

PLASTIC PAN ASSEMBLY FOR USE IN AIR CONDITIONERS AND REFRIGERATORS

BACKGROUND OF THE INVENTION

1. Background of the Invention

The present invention relates to a primary plastic pan assembly for use in conjunction with air conditioning installations and refrigeration systems, and more particularly to a plastic primary pan assembled with a supporting bracket which is mounted to a motor and a fan cover.

2. Description of the Prior Art

Primary pans are generally known to be utilized with air conditioning systems. Conventional devices utilize a primary pan made of steel which is directly mounted to a fan cover and a motor. However, these devices suffer from a number of problems such as, for example, the problem that metallic primary pans eventually become rusted and plug up outlets for draining water from the pan. Further, it is difficult for the pan to support the air condition system such as the motor and the pan cover, because of the additional weight caused by the metal pan, so that the motor cannot be used for a long time. It is also very difficult for the primary pans to separate from such devices because the structure is very complicated and device has a heavy weight.

In order to avoid such problems, U.S. Pat. No. 4,597,269, issued to the present inventor, discloses a plastic pan adapted to be mounted to the motor of an air conditioning system which includes a primary pan, a support bracket, height-adjustable brackets, and a motor mount bracket whereby the plastic pan avoids the plugging up of the outlet. However, this primary pan exhibits some problems with regard to convenient and reliable assembling and requires a lot of bolts for installation.

The present application is also prosecuting another U.S. patent application Ser. No. 07/212,699, filed June 28, 1988, which disclosed a plastic pan assembly for use in air conditioning systems and refrigerators wherein a plastic pan having a raised portion or a rail disposed on the outside surface of the bottom thereof is easily engaged with a channeled supporting bracket. However, this pan assembly requires a large space for working.

SUMMARY OF THE INVENTION

Accordingly, it is an object of the present invention to provide an improved plastic pan assembly for use in air conditioning systems and refrigerators.

Another object of the present invention is to provide a plastic primary pan which is structured for draining condensate water through an outlet while avoiding the plugging up of the outlet.

Still another object of the present invention is to provide an air conditioning system which includes an assembly for easily mounting a primary pan to a supporting bracket which has a plurality of elongated apertures and which is mounted to a motor and fan covers.

A further object of the present invention is to provide an improved primary pan for smoothly mounting to and easily separating from an air conditioning system which includes a C-shaped plastic pan having a pair of channels disposed on both sides of the outside surface of a C-shaped circumferential portion thereof, a channeled supporting bracket having a plurality of elongated apertures, and a pair of fan covers having an elongated slot disposed on the outside surface of the top for receiving the supporting bracket, a pair of rails disposed on both sides of a C-shaped circumferential recess for smoothly mounting to and separating from the pair of channels and the C-shaped circumferential portion of the primary pan, and a circumferential raised portion disposed around a lower outlet thereof for effectively mounting the fan covers to the plastic pan with only two pairs of screws.

Other objects and further scope of applicability of the present invention will become apparent from the detailed description given hereinafter. It should be understood, however, that the detailed description and specific examples, wile indicating preferred embodiments of the invention, are given by way of illustration only, since various changes and modifications within the spirit and scope of the invention will become apparent to those skilled in the art from this detailed description.

Briefly described, the present invention relates to a plastic primary pan assembly for use in conjunction with an air conditioning system, wherein a channeled supporting bracket is utilized t tightly engage and effectively support a plastic pan which includes a C-shaped circumferential portion having a pair of channels, the channeled supporting bracket having a plurality of elongated apertures being mounted on a motor and fan covers which a C-shaped circumferential recess having a pair of rails for smoothly engaging with the plastic pan, whereby the plastic primary pan assembly can be easily associated with and separate from the air conditioning system and easily adjusted to incline the plastic primary pan for drawing condensate water through an outlet disposed in the plastic primary pan.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
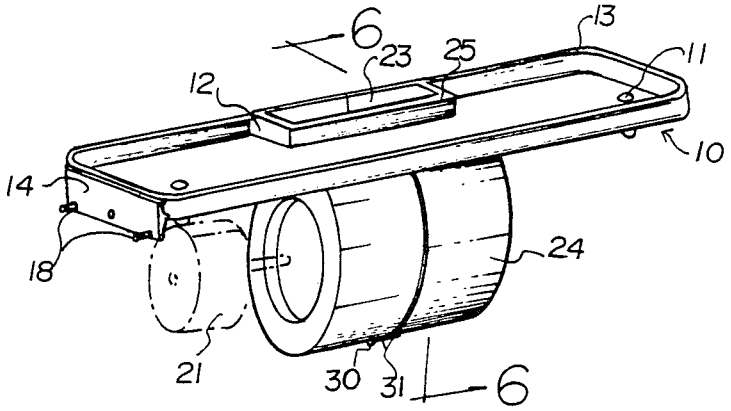
FIG. 1 is a perspective view of a plastic primary pan assembly with its associated support element.
Figure 2:
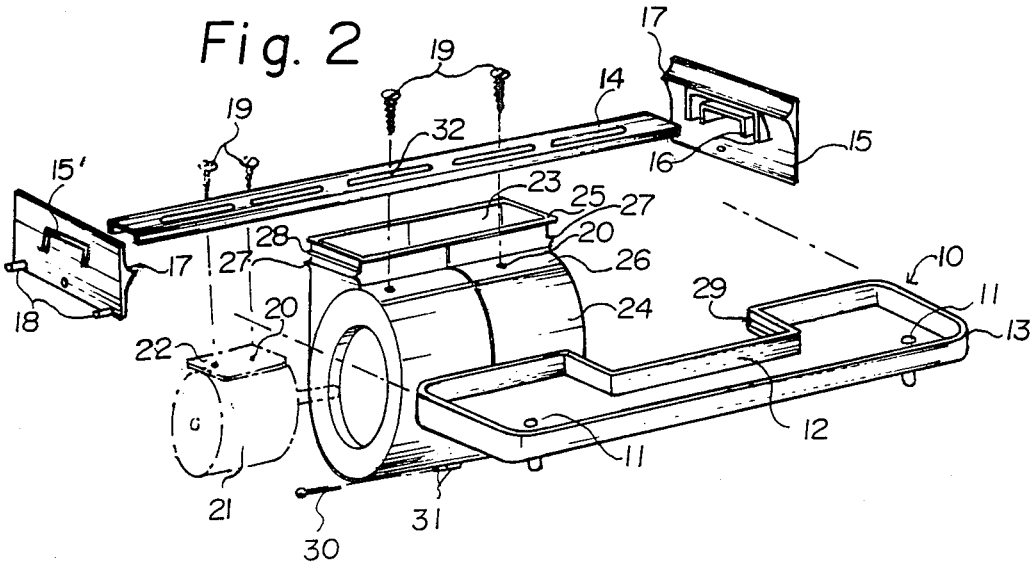
FIG. 2 is an exploded perspective view of showing basic components of a plastic primary assembly of the present invention.

Referring now in detail to the drawings for the purpose of illustrating preferred embodiments of the present invention, the plastic primary pan assembly as shown in FIGS. 1 and 2 includes a plastic primary pan 10, a channeled supporting bracket 14 which is mounted to a motor 21 and a pair of fan covers 24.

The plastic primary pan 10 is provided with two drain pipes 11 disposed in both end portions thereof for draining condensate water. Also, the plastic primary pan 10 contains a C-shaped circumferential portion 12 disposed on one side of the rectangular configuration thereof. The C-shaped circumferential portion 12 has a pair of channels 29 disposed in parallel sides thereof. The channeled supporting bracket 14 for receiving the primary pan 10 contains a plurality of elongated apertures 32 for adjustably receiving screws 19. The channeled supporting bracket 14 is provided with a pair of engaging plates 15 for supporting and engaging to a housing of the air conditioning system (not shown).

Figure 4:
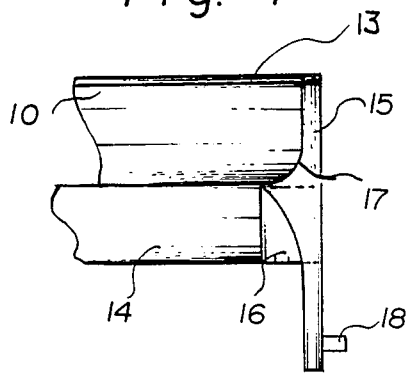
FIG. 4 is an enlarged front view of showing the attachment the plastic primary pan and a supporting bracket to an engaging plate of the present invention in an assembled position.
Figure 5:
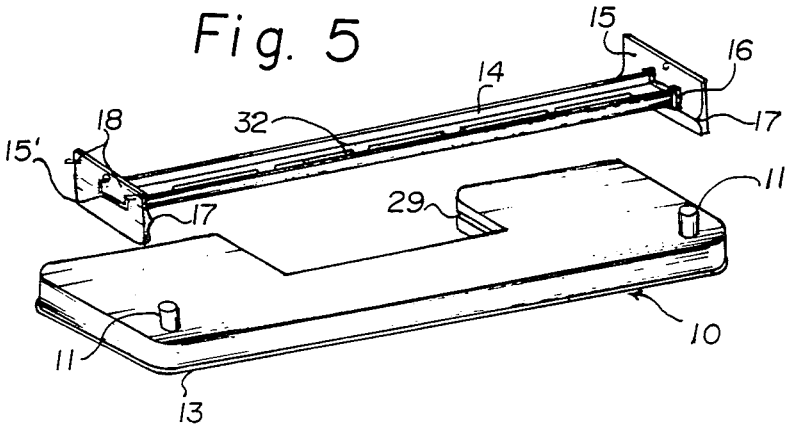
FIG. 5 is an exploded perspective view of the primary pan and supporting bracket of the present invention in a turned over position.

As shown in FIGS. 2, 4, and 5, since the engaging plates 15 have U-shaped apertures 15, defined by U-shaped rail 16, respectively, the channeled supporting bracket 14 can be effectively engaged in the U-shaped channel 17 of the pair of plates 15. Also, the engaging plates 15 have raised portion 17 for supporting the plastic primary pan 10 and a pair of pins 18 for inserting into walls of the housing.

Figure 6:
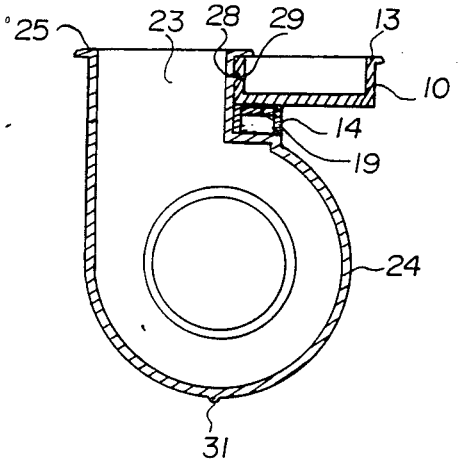
FIG. 6 is a sectional view of FIG. 1 showing the attachment of the pan cover to the plastic primary pan and supporting bracket of the present invention.

As shown in FIGS. 1, 2, and 6, the pair of fan covers 24 each contain a lower outlet 23 which has a circumferential raised portion 25 for being adapted to suspend to the C-shaped circumferential portion 12 of the plastic primary pa 10. The fan covers 24 have an elongated slots 26 disposed on the top surface thereof for receiving the supporting bracket 14 by screw 19 through apertures 20 of the pan covers 24 (FIG. 6). The fan covers 24 include a C-shaped circumferential recess 27 disposed in the top portion thereof and the C-shaped circumferential recess 27 has rails 28 disposed on both parallel sides thereof for easily mounting to and separating from the pair of channels 29 disposed on the C-shaped circumferential portion 25 of the primary pan 10. Also, the fan covers have pin engagements 31, respectively, for receiving a pin 30 to combine them together. The motor 21 is provided with a motor plate 22 for being mounted to the supporting bracket 14 by screws 19 through the apertures 20 of the motor plate 22. Accordingly, since the motor 21 is mounted to the straight supporting bracket 14, it is believed that the motor 21 can be maintained for a long time when compared with the motor utilized the conventional air conditioning devices.

Figure 3:
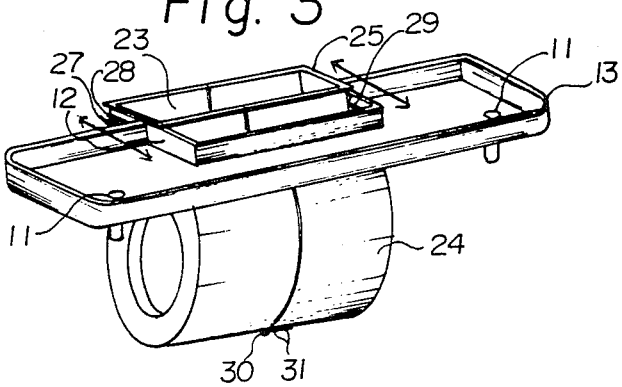
FIG. 3 is a perspective view of showing the plastic primary pan and pan covers of the present invention in an inserting position.

In assembly, the engaging plates 15 are attached to both ends of the channeled supporting bracket 14 through the U-shaped apertures 15' of the engaging plates 15. Thereafter, the engaging plates 15 are attached to the walls of the housing of the air conditioning system with the inclination for easily drawing condensate water through one of the drain pipes 11. After the fan covers 24 containing a fan (not shown) are combined together with the pin 30 through the pin engagements 31, the channeled supporting bracket 14 is engaged with the combined fan covers 24 by screws 19 through the elongated slots 32 and the apertures 20 of the fan covers 24. And the motor 21 is mounted to the supporting bracket 14 by screws 19 through the elongated apertures 32 of the supporting bracket 14 and the apertures 20 of the motor plate 22. Finally, the plastic primary pan 10 is engaged with an separate from the supporting bracket 14 containing the motor 21 and the fan covers 24 by inserting the channels 29 of the pan 10 into the rails 28 of the pan covers 24. The circumferential raised portion 25 of the fan covers 24 are engaged with a top surface 13 of the C-shaped circumferential portion 12 of the pan 10 (FIG. 3).

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A primary pan assembly adapted to be mounted to the motor of an air conditioning system which comprises:

a plastic primary pan provided with a drainage hole disposed on at least one side thereof and a C-shaped circumferential portion on one side thereof, said C-shaped circumferential portion having a pair of channels disposed on both sides thereof, a channeled supporting bracket having a plurality of elongated apertures disposed in the center thereof for supporting said plastic primary pan, a motor mounted to said channeled supporting bracket by screws through said elongated apertures, and a pair of fan covers having elongated slots disposed on the top surface thereof for receiving said supporting bracket, circumferential raised portion disposed around a lower outlet thereof for suspending aid fan covers on said C-shaped circumferential portion of the plastic primary pan, and a C-shaped circumferential recess disposed in top portion thereof wherein the C-shaped circumferential recess has a pair of rails disposed in both parallel sides thereof for easily engaging with said pair of channels, whereby the primary pan assembly can be mounted to housing walls of the air conditioner system at an inclination for easily draining the condensate water through the drainage hole and can be easily installed without a large number of screws and a large space for working, and the primary pan can be smoothly mounted to and separated from the channeled supporting bracket.

2. The primary pan assembly of claim 1, wherein the channeled supporting bracket is provided with a pair of engaging plates which have U-shaped apertures formed between U-shaped rails thereon for receiving said channeled supporting bracket, said engaging plates being installable onto the housing wall of the air conditioning system.

3. The primary pan assembly of claim 2, wherein the engaging plates have a pair of pins for easily installing onto the housing wall of the air conditioning system, respectively.

4. The primary pan assembly of claim 1, wherein the channeled supporting bracket is made of aluminum.

5. The primary pan assembly of claim 1, wherein the channeled supporting bracket is made of steel.

6. The primary pan assembly of claim 1, wherein the channeled supporting bracket is made of plastic.

* * * * *